US005524319A

United States Patent [19]

Avidor

[11] Patent Number: 5,524,319

[45] Date of Patent: Jun. 11, 1996

[54] TOOTHBRUSH HAVING SPRING-MOUNTED BRISTLE HOLDERS

[76] Inventor: Joseph Avidor, 20 Hapardes St., Ramat Hasharon, Israel

[21] Appl. No.: 454,697

[22] Filed: May 31, 1995

[51] Int. Cl.[6] ..... A46B 7/06; A46B 9/04

[52] U.S. Cl. ..... 15/167.1; 15/201

[58] Field of Search ..... 15/167.1, 201

[56] References Cited

U.S. PATENT DOCUMENTS

| | | | |
|---|---|---|---|
| 2,266,195 | 12/1941 | Hallock | 15/167.1 |
| 2,582,552 | 1/1952 | Marco | 15/167.1 |
| 2,882,544 | 4/1959 | Hadidian | 15/201 |
| 2,935,755 | 5/1960 | Leira et al. | 15/167.1 |
| 3,082,457 | 3/1963 | Lucibello et al. | 15/201 |
| 3,152,349 | 10/1964 | Brennesholtz | 15/201 |
| 3,683,442 | 8/1972 | Holly | 15/201 |
| 4,240,452 | 12/1980 | Jean | 15/201 |
| 4,633,542 | 1/1987 | Taravel | 15/201 |
| 4,691,405 | 9/1987 | Reed | 15/201 |
| 4,694,844 | 9/1987 | Berl et al. . | |
| 5,138,734 | 8/1992 | Chung | 15/167.1 |
| 5,184,368 | 2/1993 | Holland | 15/167.1 |
| 5,350,248 | 9/1994 | Chen | 15/201 |

FOREIGN PATENT DOCUMENTS

| | | | |
|---|---|---|---|
| 707727 | 7/1931 | France | 15/167.1 |
| 195608 | 2/1908 | Germany | 15/167.1 |
| 4122524 | 2/1992 | Germany | 15/167.1 |
| 5-76416 | 3/1993 | Japan | 15/201 |

*Primary Examiner*—Mark Spisich
*Attorney, Agent, or Firm*—Ladas & Parry

[57] ABSTRACT

A toothbrush includes a brush head formed with a plurality of cavities, and an assembly of bristle holders received in the cavities, the bristle holders being fixed to and interconnected together by spring elements engageable with the bottoms of the cavities and normally urging the bristle holders to a projected position outwardly of the brush head, but permitting the bristle holders to be displaced inwardly to a retracted position within their respective cavities.

24 Claims, 4 Drawing Sheets

FIG.5
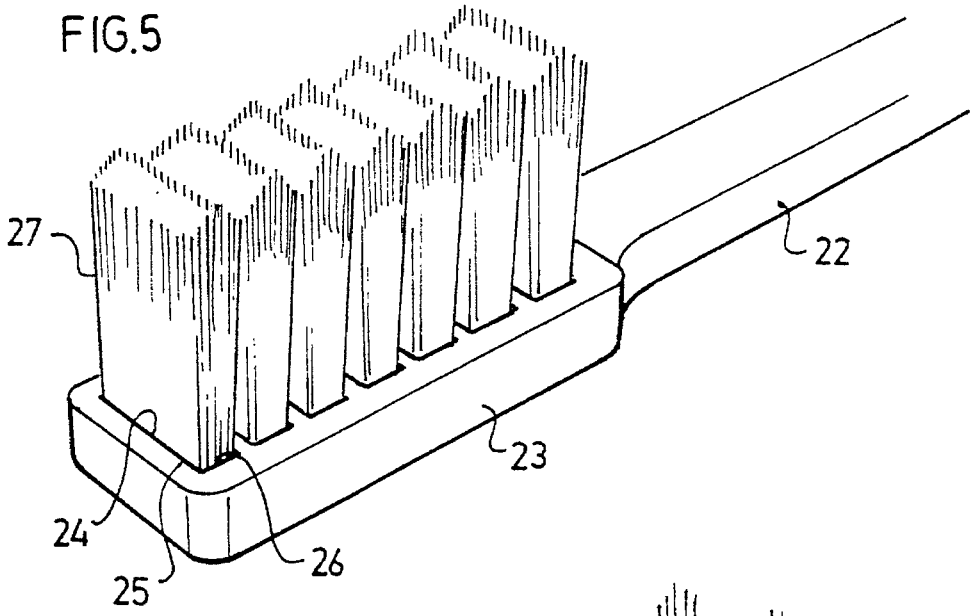
FIG.6
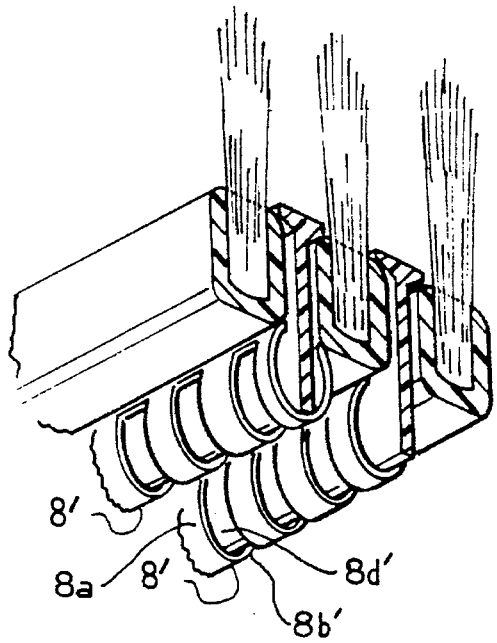
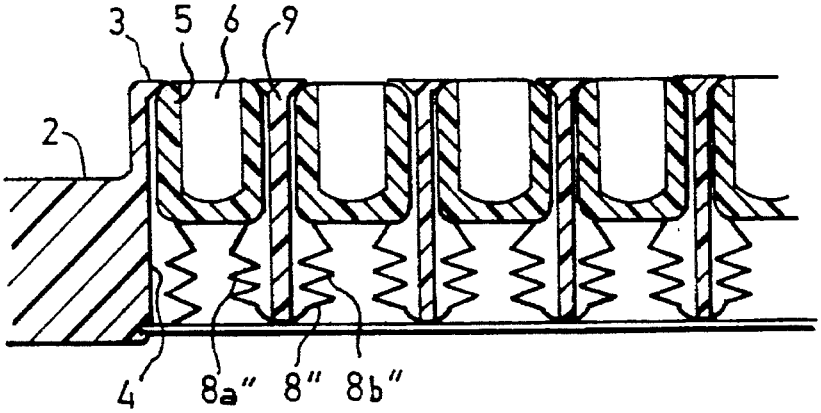
FIG 7

TOOTHBRUSH HAVING SPRING-MOUNTED BRISTLE HOLDERS

FIELD AND BACKGROUND OF THE INVENTION

The present invention relates to toothbrushes, and particularly to toothbrushes having spring-mounted bristle holders.

A large number of different types of toothbrushes having spring mountings for the bristle holders have been designed and are described in the patent literature, for example in U.S. Pat. Nos. 5,184,368, 4,694,844 and 2,935,755. However, one of the drawbacks in such constructions is the relatively large number of parts which must be produced and assembled, so that the cost for such toothbrushes is generally very high as compared to a conventional toothbrush. Despite the advantages of toothbrushes with spring-mounted bristles, their high cost substantially limits the ability of the public to purchase and use them.

OBJECTS AND BRIEF SUMMARY OF THE INVENTION

An object of the present invention is to provide a toothbrush which includes spring-mounted bristle holders, but which can be produced in volume and at relatively low cost as compared to other toothbrushes of this type.

According to one aspect of the present invention, there is provided a toothbrush comprising: an elongated handle; a brush head at an end of the handle and including a retractable-bristle section having a longitudinal axis and formed with a plurality of cavities; a plurality of bristle holders, each holding a bunch of bristles and each displaceably mounted in a respective one of the cavities; and spring elements urging the bristle holders to a projecting position outwardly of their respective cavities, but permitting the bristle holders to be displaced to a retracted position inwardly of their respective cavities; characterized in that each of the cavities, and its respective bristle holder, extends for substantially the complete width of the retractable-bristle section of the brush head transversely of the longitudinal axis and is spaced from each other along the longitudinal axis; and in that the spring elements interconnect the bristle holders and support them in their respective cavitites of the retractable-bristle section of the brush head.

According to a further feature in the described preferred embodiments, the spring elements are integrally formed with the bristle holders as a unitary assembly of plastic material.

According to a further aspect of the present invention, there is provided a toothbrush comprising: a handle having a brush head at an end thereof; the brush head including a top wall and a bottom wall extending longitudinally of the brush head in parallel spaced relation; a plurality of displaceable bristle holders displaceably mounted in the brush head between the top and bottom walls, and being spring-urged towards the top wall to a projected position but being displaceable towards the bottom wall to a retracted position; each of the displaceable bristle holders including at least one bunch of bristles; and at least one further bunch of bristles fixed to the brush head.

A toothbrush constructed in accordance with the foregoing features permits the toothbrush to be built of relatively few parts which can be produced and assembled at relatively low cost. In addition, when the toothbrush is properly used by applying up-and-down motions parallel to the bristle holders, the bristles better penetrate the spaces between the teeth for more efficient cleaning.

Further features and advantages of the invention will be apparent from the description below.

BRIEF DESCRIPTION OF THE DRAWINGS

The invention is herein described, by way of example only, with reference to the accompanying drawings, wherein:

FIG. 5 is a three-dimensional view illustrating a modification in the construction of the brush head;

FIG. 6 is a three-dimensional view illustrating a modification in the construction of the leaf springs connecting the bristle holders;

FIG. 7 is a view similar to that of FIG. 3 but illustrating another construction of the leaf springs connecting the bristle holders.

DESCRIPTION OF PREFERRED EMBODIMENTS

Figure 1:
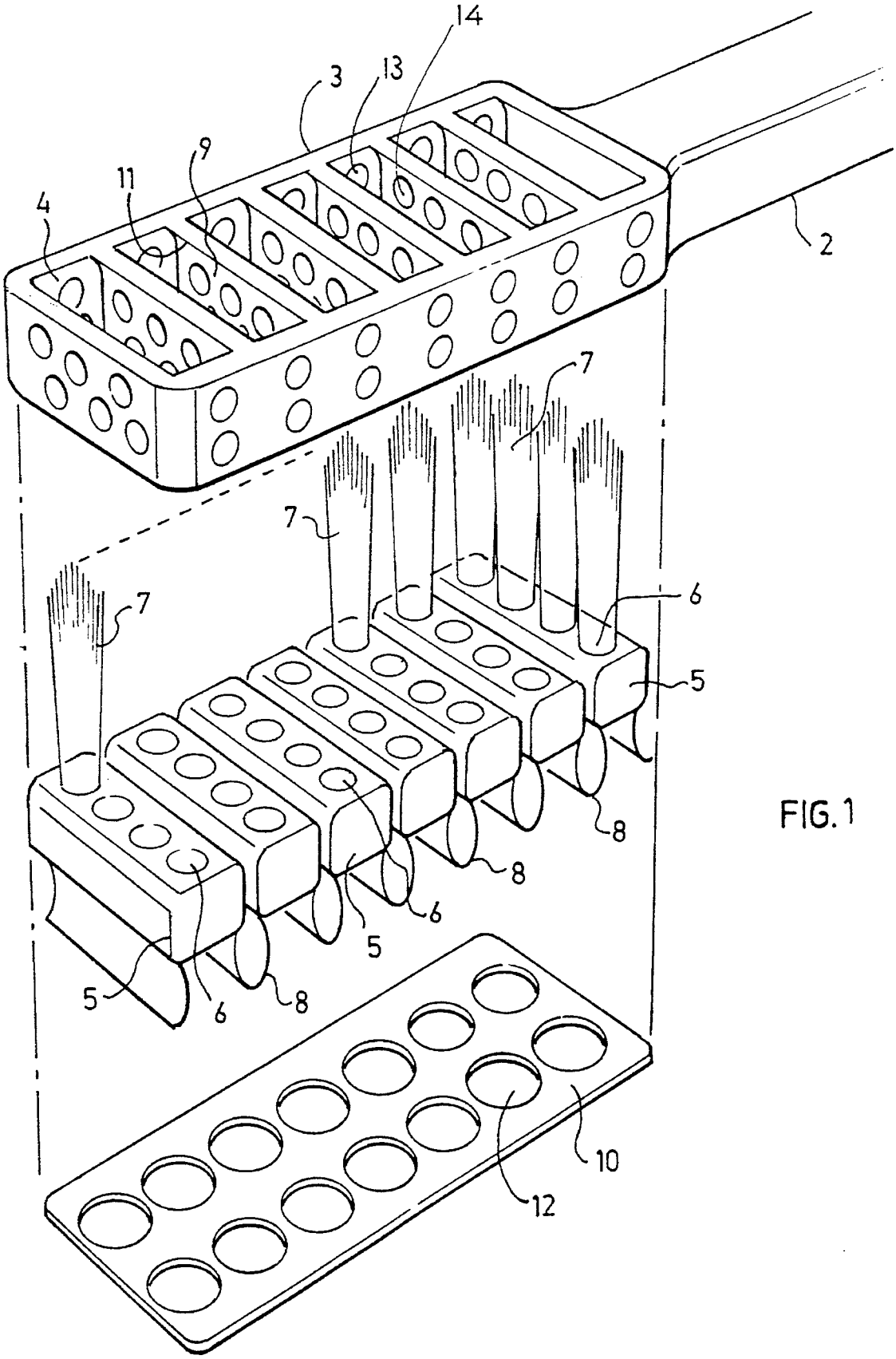
FIG. 1 is an exploded three-dimensional view illustrating the main components of a toothbrush constructed in accordance with the present invention.
Figure 2:
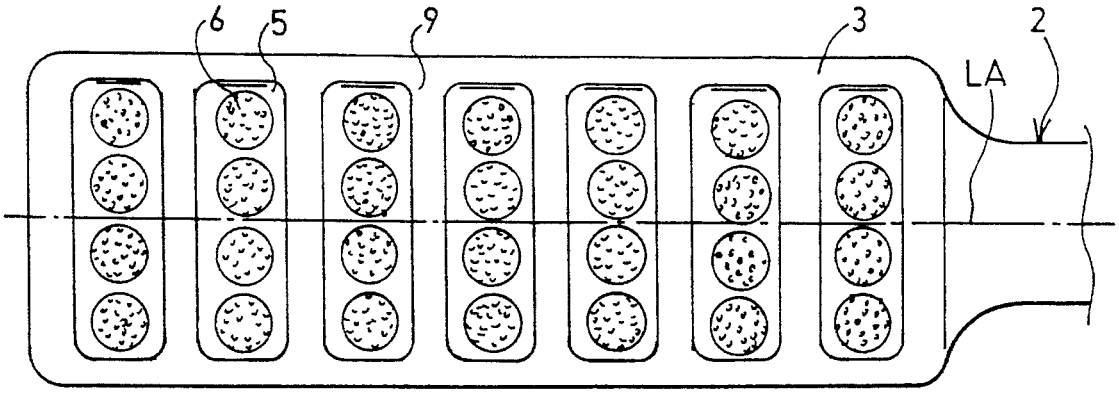
FIG. 2 is a top plan view of the brush head illustrated in FIG. 1.

The toothbrush illustrated in FIGS. 1 and 2 comprises a handle 2 at one end integrally formed at its opposite end with a brush head 3. The brush head 3 is formed with a retractable bristle section including a plurality of rectangular cavities 4 each extending transversely to the longitudinal axis LA (FIG. 2) of the toothbrush and spaced longitudinally of the toothbrush.

Each of the cavities 4 is adapted to receive a bristle holder 5 of complementary shape as the respective cavity. Each bristle holder 5 is formed with a plurality of cylindrical pockets 6 along its length (i.e., along the width of the toothbrush), with each pocket filled with an individual bunch of bristles 7. All the bristle holders 5 are joined and interconnected together into a common assembly by a plurality of elastic sections defining spring elements 8 each fixed between a pair of adjacent bristle holders.

Figure 3:
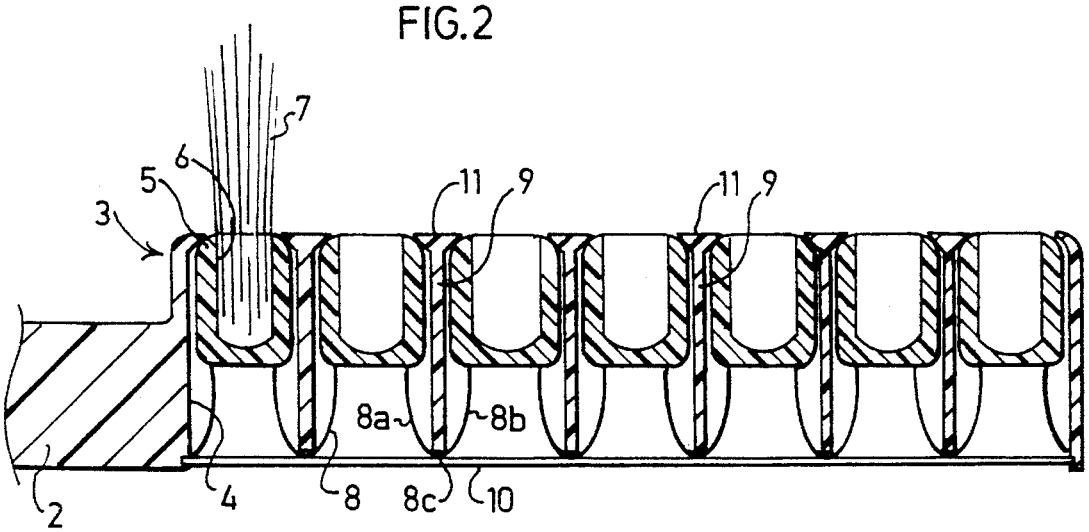
FIG. 3 is a longitudinal sectional view of the brush head of FIG. 2 illustrating the normal condition of the bristle holder.

Preferably, the bristle holders 5 are produced as an integral unit, e.g., by injection molding, with the spring elements 8 of the same material as the bristle holders and formed as integral hinges interconnecting the bristle holders. The cavities 4 are preferably formed through the complete thickness of the brush head 3 permitting the assembly of the bristle holders 5 and their integrally-formed spring elements 8 to be inserted into the cavities 4 via the bottom side of the brush head 3, with the lower edges of the partitions 9 between the cavities 4 engageable with the bends of the spring elements 8, as shown in FIG. 3. The cavities 4 of the brush head 3 are closed by a common bottom wall 10 fitted into the bottom of the brush head.

The interconnecting spring elements 8 are each formed with a pair of legs 8*a*, 8*b* fixed at their outer ends to the respective pair of bristle holders 5 and joined at their inner ends by a U-shaped bend 8*c*. The upper faces of the bends 8*c* engage the lower surface of the respective partition wall 9, whereas the lower faces of the bends 8*c* engage the upper surface of the bottom wall 10.

Figure 4:
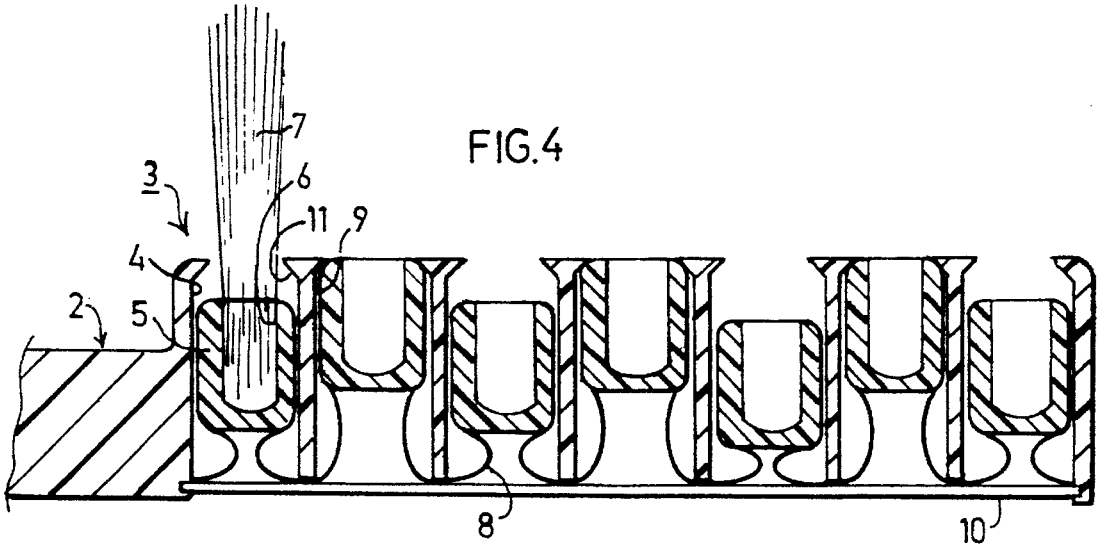
FIG. 4 is a view corresponding to that of FIG. 3 but illustrating the depressed condition of some of the bristle holders.

As shown in FIGS. 3 and 4, the spring elements 8 normally urge their respective bristle holders 5 to their projected positions, shown in FIG. 3, wherein the upper surfaces of the bristle holders engage limit shoulders 11 formed in the brush head 3, and particularly in the partition walls 9 between the cavities 4. Spring elements 8, however, permit the individual bristle holders 5 to be displaced inwardly to a retracted position within their respective cavities 4 at the time of brushing as shown in FIG. 4.

The closure plate 10 is formed with a plurality of drain openings 12, as seen particularly in FIG. 1, to permit the water to drain from the brush head. In addition the outer walls of the brush head 3, and also its partition walls 9 between the cavities 4, are similarly formed with drain openings 13 and 14, respectively.

It will thus be seen that the toothbrush illustrated in FIGS. 1 and 2 may be constructed of but a few parts, namely, the handle 2 and the brush head 3, the assembly of bristle holders 5 integrally formed with the interconnecting spring elements 8, and the bottom wall 10, and that these parts may be assembled in a quick and simple manner. Such an arrangement, wherein the bristle holders 5 extend transversely of the brush head 3, tends to encourage the user to brush the teeth parallel to the bristle holders, i.e., with an up-and-down motion, such that the bristles 7 carried by the holders 5 move parallel to the direction of the teeth and therefore better enter the spaces between the teeth for more efficient cleaning.

FIG. 5 illustrates another toothbrush construction including a handle 22 and a brush head 23 formed with a plurality of transversely-extending cavities 24 each receiving a bristle holder 25 of a bristle holder assembly. In the modification of FIG. 5, however, the bristle holders 25 are not formed with a plurality of individual cylindrical pockets (6, FIG. 1) for receiving the bristles, but rather are formed with a single elongated pocket 26 extending the length of the bristle holder and filled with the bristles 27. Such a construction not only reduces the number of operations required for applying the bristles to their respective holders, but also permits a larger quantity of bristles to be carried by the brush head. In all other respects, the construction illustrated in FIG. 5 may be the same as described above with respect to FIGS. 1–4.

FIG. 6 illustrates a modification in the construction of the interconnecting spring elements 8'. In this modification, the legs 8*a*', 8*b*' of each spring element are formed with a plurality of interruptions 8*d*' spaced along their lengths, with the interruptions of one spring element being staggered with respect to the interruptions of the adjacent spring elements. Such a construction increases the flexibility of the interconnecting spring elements and permits larger displacement magnitudes of the bristle holders.

FIG. 7 illustrates a further modification wherein each leg of each spring element 8" is of zigzag configuration, as shown at 8*a*" and 8*b*" in FIG. 7, to better accommodate the deflection of the spring elements during use.

Figure 8:
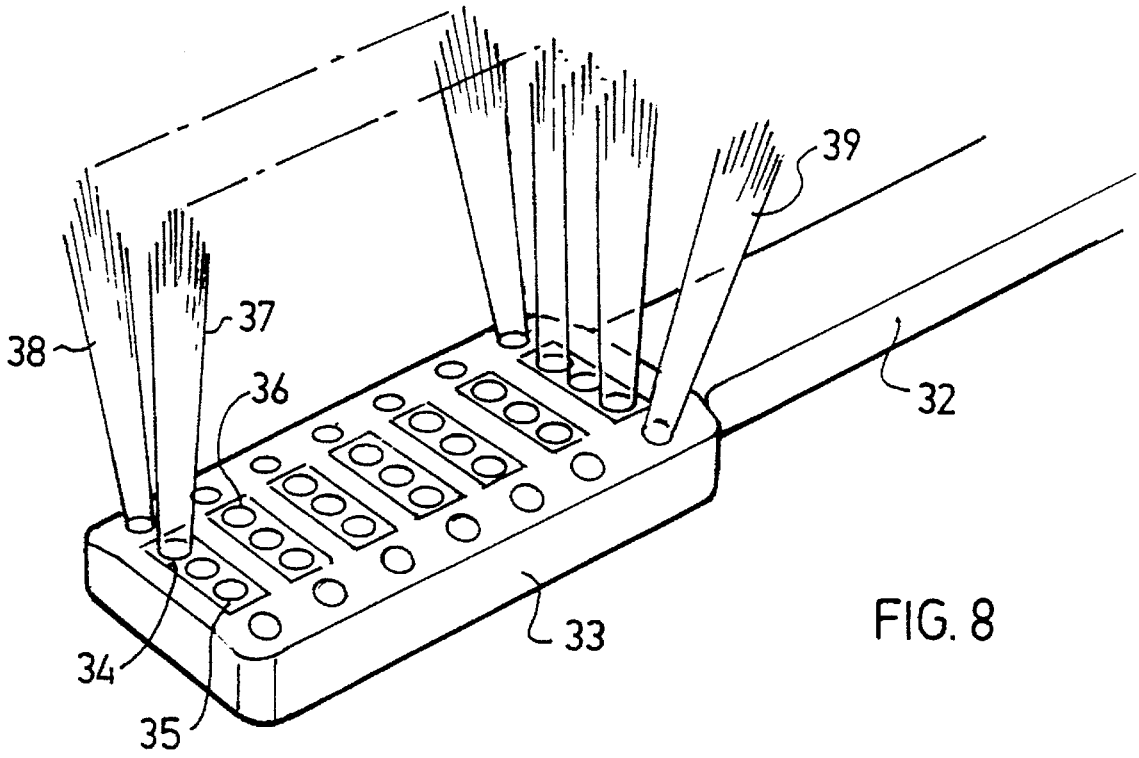
FIG. 8 is a three-dimensional view illustrating a further toothbrush constructed in accordance with the present invention.

In the above-described constructions, all the bristle holders of the brush head are retractable. FIG. 8 illustrates another construction wherein the brush head includes fixed bristle holders in addition to retractable-bristle holders.

Thus, the toothbrush illustrated in FIG. 8 includes a handle 32 and a brush head 33 at one end. The brush head is formed with a retractable-bristle section including a plurality of cavities 34 extending transversely for substantially the complete width of the respective section and spaced longitudinally of the brush head. A bristle holder 35 is displaceably mounted in each cavity 34. Each bristle holder is formed with a plurality of cylindrical pockets 36 receiving a bunch of bristles 37.

The retractable-bristle section of brush head 33 is flanked on each of its opposite sides by an additional bristle holder 38, 39, fixed in the brush head 33 in alignment with each of the displaceable bristle holders 35. Preferably, the fixed bristle holders 38 hold bristles slightly diverging from the bristles 37 carried by the displaceable bristle holders 35.

While the invention has been described with respect to several preferred embodiments, it will be appreciated that these are set forth merely for purposes of example, and that many other variations may be made. For example, in order to reduce the initial tooling costs, the interconnecting spring elements 8, may be produced as a separate unit and assembled with the bristle holders 5 into a common assembly before being assembled into the brush head. Further, the assembly of bristle holders 5 and interconnecting spring elements 8 may be inserted via the top of the brush head 3, in which case the bottom wall 10 could be integrally formed with the brush head 3 and the handle 2, and could be retained within the brush head by a retainer member formed with the partition walls 9 applied over the insert assembly.

Many other variations, modifications and applications of the invention will be apparent.

I claim:

1. A toothbrush, comprising:

an elongated handle;

a brush head at end of the handle and including a retractable-bristle section having a longitudinal axis and formed with a plurality of cavities;

a plurality of bristle holders, each holding a bunch of bristles and each displaceably mounted in a respective one of said cavities;

and spring elements urging said bristle holders to a projecting position outwardly of their respective cavities, but permitting the bristle holders to be displaced to a retracted position inwardly of their respective cavities;

characterized in that each of said cavities, and its respective bristle holder, extends for substantially the complete width of said retractable-bristle section of the brush head transversely of said longitudinal axis and is spaced from each other along said longitudinal axis; and in that said spring elements interconnect said bristle holders and support them in their respective cavities of said retractable-bristle section of the brush head.

2. The toothbrush according to claim 1, wherein said spring elements are integrally formed with said bristle holders as a unitary assembly of plastic material.

3. The toothbrush according to claim 1, wherein said retractable-bristle section of the brush head is closed by a bottom wall, and said spring elements engage said bottom wall.

4. The toothbrush according to claim 3, wherein said bottom wall is formed with a plurality of drain openings.

5. The toothbrush according to claim 3, wherein said spring elements include U-shaped bends having lower faces engaging said bottom wall.

6. The toothbrush according to claim 5, wherein said cavities are defined by partition walls integrally formed with said brush head and engageable with said U-shaped bends.

7. The toothbrush according to claim 6, wherein said partition walls are formed with a plurality of drain openings.

8. The toothbrush according to claim 7, wherein each of said spring elements further includes a pair of legs connected together at respective inner ends thereof by said U-shaped bends, and connected to the bristle holders at respective outer ends thereof.

9. The toothbrush according to claim 8, wherein each of said legs of each spring element has a plurality of interruptions spaced along its length.

10. The toothbrush according to claim 9, wherein the interruptions of one pair of legs are staggered with respect to the interruptions of the adjacent pair of legs.

11. The toothbrush according to claim 8, wherein each of said legs of each spring element is of a zigzag configuration.

12. The toothbrush according to claim 1, wherein said retractable bristle section extends for substantially the complete width of the brush head.

13. The toothbrush according to claim 1, wherein said retractable bristle section is flanked on each of its opposite sides width wise thereof by a bunch of bristles fixed in the brush head in alignment with each of said displaceable bristle holders.

14. A toothbrush comprising:

a handle having a brush head at an end thereof carrying a plurality of bristles;

said brush head having a longitudinal axis and being formed with a plurality of cavities;

said bristles being carried by an assembly of a plurality of bristle holders received in said cavities and interconnected together as a common assembly by spring elements fixed to and between said bristle holders.

15. The toothbrush according to claim 14, wherein each of said cavities, and each of said bristle holders therein, extends substantially for the complete width transversely of said longitudinal axis of the brush head.

16. The toothbrush according to claim 14, wherein each of said spring elements includes a pair of legs joined together at respective inner ends and fixed at respective outer ends to the bristle holders.

17. The toothbrush according to claim 16, wherein said pair of legs of each of said spring elements are joined together at respective inner ends by a U-shaped bend engageable with a bottom wall of the brush head.

18. The toothbrush according to claim 17, wherein said cavities are defined by partition walls integrally formed with said brush head and engageable with said U-shaped bends.

19. The toothbrush according to claim 14, wherein said spring elements are integrally formed with and of the same material as said bristle holders.

20. A toothbrush comprising:

a handle having a brush head at an end thereof;

said brush head including a top wall and a bottom wall extending longitudinally of the brush head in parallel spaced relation;

a plurality of displaceable bristle holders displaceably mounted in said brush head between said top and bottom walls, and being spring-urged towards said top wall to a projected position but being displaceable towards said bottom wall to a retracted position;

each of said displaceable bristle holders including at least one bunch of bristles;

and at least one further bunch of bristles fixed to the brush head.

21. The toothbrush according to claim 20, wherein each of said bristle holders extends transversely across the brush head and said bristle holders are spaced from each other longitudinally of the brush head; and wherein said fixed bunch of bristles is fixed to the brush head laterally of said displaceable bristle holders along at least one longitudinal side of the brush head.

22. The toothbrush according to claim 21, wherein there is at least one fixed bunch of bristles fixed to the brush head laterally of and aligned with each of said bristle holders.

23. The toothbrush according to claim 22, wherein there are two of said fixed bunches of bristles fixed to the brush head laterally on opposite longitudinal sides of and aligned with each of said bristle holders.

24. The toothbrush according to claim 20, wherein each of said displaceable bristle holders extends substantially for the complete width transversely of the brush head.

* * * * *